US010952919B2

(12) United States Patent
Ben-Noon

(10) Patent No.: US 10,952,919 B2
(45) Date of Patent: Mar. 23, 2021

(54) PNEUMOMASSAGE SLEEVE

(71) Applicant: Mego Afek AC Ltd., Kibbutz Afek (IL)

(72) Inventor: Asher Ben-Noon, Carmiel (IL)

(73) Assignee: MEGO AFEK AC LTD., Kibbutz Afek (IL)

( * ) Notice: Subject to any disclaimer, the term of this patent is extended or adjusted under 35 U.S.C. 154(b) by 215 days.

(21) Appl. No.: 15/951,359

(22) Filed: Apr. 12, 2018

(65) Prior Publication Data

US 2018/0296428 A1 Oct. 18, 2018

Related U.S. Application Data

(60) Provisional application No. 62/484,937, filed on Apr. 13, 2017.

(51) Int. Cl.
*A61H 9/00* (2006.01)

(52) U.S. Cl.
CPC ..... *A61H 9/005* (2013.01); *A61H 9/0007* (2013.01); *A61H 9/0078* (2013.01); (Continued)

(58) Field of Classification Search
CPC ..... A61H 1/02; A61H 1/0237; A61H 1/024; A61H 1/0266; A61H 1/0274; A61H 1/0277; A61H 1/0285; A61H 9/00; A61H 9/0007; A61H 9/0021; A61H 9/005; A61H 9/0078; A61H 9/0085; A61H 9/0092; A61H 2201/1635; A61H 2201/1638; A61H 2201/164; A61H 2201/1642; A61H 2201/1645; A61H 2201/1647; A61H 2205/10; A61H 2205/102; A61H 2205/106; A61H 2205/12; A61H 2205/06; A61H 2205/065; A41B 11/12; A41B 11/125; A61F 13/08; A61F 13/085; A61F 13/061; A61F 13/062; A61F 13/107; A61F 13/06; A61F 5/0109; A61F 5/01; A61F 5/0102; A61F 5/0106; A61F 5/042; A61F 5/048; A61F 5/0111; A61F 5/0118; A61F 5/0123; A61F 5/0127; A61F 5/013; A61F 2005/0158; A61F 2005/0165
(Continued)

(56) References Cited

U.S. PATENT DOCUMENTS 3,934,583 A * 1/1976 Hollingshead ..... A61F 5/0585 602/62
4,338,923 A 7/1982 Gelfer et al.
(Continued)

FOREIGN PATENT DOCUMENTS

BE 503998 6/1951
EP 1219279 7/2002
(Continued)

*Primary Examiner* — Colin W Stuart
(74) *Attorney, Agent, or Firm* — The Roy Gross Law Firm, LLC; Roy Gross

(57) ABSTRACT

A pneumomassage device, and method of using the device, which includes a sleeve sized to cover a first and a second adjacent body parts and an anatomical joint therebetween; and a securing assembly for securing the first and the second adjacent body parts in a fixed position relative to one another, to allow sleeve adjustment to the lengths of the adjacent body part.

14 Claims, 9 Drawing Sheets

(52) U.S. Cl.
CPC ..... *A61H 9/0092* (2013.01); *A61H 2201/165* (2013.01); *A61H 2201/1642* (2013.01); *A61H 2201/1645* (2013.01); *A61H 2205/06* (2013.01); *A61H 2205/10* (2013.01); *A61H 2205/12* (2013.01)

(58) Field of Classification Search
USPC ..... 602/60–63, 26, 20
See application file for complete search history.

(56) References Cited

U.S. PATENT DOCUMENTS

| | | | | |
|---|---|---|---|---|
| 5,014,681 | A | 5/1991 | Heeman et al. | |
| 5,891,079 | A * | 4/1999 | Barnes | A61F 5/0118 128/881 |
| 6,406,445 | B1 | 6/2002 | Ben-Nun | |
| 6,406,495 | B1 | 6/2002 | Schoch | |
| 7,857,776 | B2 * | 12/2010 | Frisbie | A61F 5/0127 602/12 |
| 2008/0004558 | A1 * | 1/2008 | Outred | A61F 5/0113 602/28 |
| 2009/0177132 | A1 * | 7/2009 | Reis | A61F 5/05816 602/13 |
| 2012/0065564 | A1 * | 3/2012 | Hoffmeier | A61F 5/0113 602/28 |
| 2015/0265450 | A1 * | 9/2015 | Rodgers | A61F 5/0127 601/84 |

FOREIGN PATENT DOCUMENTS

| | | | |
|---|---|---|---|
| EP | 2842537 | A1 | 3/2015 |
| WO | 9204880 | | 4/1992 |
| WO | 2008032309 | | 3/2008 |
| WO | 2015196190 | | 12/2015 |

* cited by examiner

PNEUMOMASSAGE SLEEVE

FIELD OF THE INVENTION

Embodiments of the disclosure relate to devices and methods for providing pneumomassage treatment.

BACKGROUND

Lymph is a clear fluid which circulates in tissue spaces of the vertebrates and by way of a tubular network passes into the venous system. Lymph is derived from the liquid plasma of the blood but without the red corpuscles. Lymphedema is a disorder that often follows a surgical procedure such as a lymphnode dissection of the groin in the treatment of cancer. It results in an excessive accumulation of lymph in the body tissues which if not reduced may have serious consequences.

To reduce lymphedema or other abnormality giving rise to excess fluid in an afflicted body part, such as an upper or lower limb, it is known to provide a device to compress successively portions of the afflicted part to produce a sequential or peristaltic action pumping excess fluid toward the heart. This device can also be used to improve blood circulation.

In order to massage both the foot and lower leg of a patient afflicted with edema, one option known in the art is to use a device in a boot format having a series of compartments which conform to the contours of a human foot and leg. However, the boot can only be used with those patients whose foot and leg fit into the boot.

Alternatively it is known to fit a conical or tubular sleeve on the leg and to fit a separate sleeve on the foot. The advantage of this arrangement is that the patient, as he is being treated, is free to maintain his foot in a natural position and to flex it. This freedom of foot movement promotes the comfort of the patient and is desirable when the treatment is to be carried out for a prolonged period. However, the need for separate foot and leg sleeves and to sequentially inflate the cells in the sleeves introduces unwanted complications.

There is thus a need for sleeves which fit and conform to broad ranges of foot and lower leg dimensions.

The foregoing examples of the related art and limitations related therewith are intended to be illustrative and not exclusive. Other limitations of the related art will become apparent to those of skill in the art upon a reading of the specification and a study of the figures.

SUMMARY

The following embodiments and aspects thereof are described and illustrated in conjunction with systems, tools and methods which are meant to be exemplary and illustrative, and not limiting in scope.

According to some embodiments, there is provided a pneumomassage device comprising: a pneumomassage sleeve adapted to fit onto a first and a second adjacent body parts and an anatomical joint therebetween, the sleeve comprising: a proximal section that conforms to the first body part; a distal section that conforms to the second body part; and a joint section between the proximal section and the distal section that is configured to conform with the anatomical joint, and a releasable securing assembly comprising: a first coupling element coupled to and extends outward from an outer surface of the proximal section of the sleeve; and a second coupling element coupled to and extends outward from an outer surface of the distal section of the sleeve, wherein upon coupling the first coupling element to the second coupling element, a relative position between the first coupling element and the second coupling element defines a position of a bend within the joint section, thereby co-axially aligning the proximal section with a portion of the joint section proximal to the bend, and the distal section with a portion of the joint section distal to the bend to determine a ratio between a length of the proximal section and a length of the distal section.

In some embodiments, the first coupling element extends essentially perpendicularly to the proximal section and wherein the second coupling element extends essentially perpendicularly to the distal section.

In some embodiments, the first coupling element is positioned on an anterior side of the proximal section and the second coupling element is positioned on an anterior side of the distal section.

In some embodiments, the first and/or second coupling elements are integrally formed with the respective proximal and/or distal sections. In some embodiments, the first and/or second coupling elements are in the form of elongated strips.

In some embodiments, the releasable securing assembly comprises a hook-and-loop fastener.

In some embodiments, the pneumomassage sleeve envelops one or more inflatable cells formed of air-impermeable material. In some embodiments, each of the one or more inflatable cells is fluidly connected to an air compressor which operates to inflate and/or deflate the one or more cells. In some embodiments, the one or more inflatable cells comprises a plurality of cells configured to be inflated and/or deflated in a desired sequence.

In some embodiments, the fastener consists of a lineal fabric strip with hooks that configured to couple with another fabric strip with smaller loops, attaching temporarily, until pulled apart. In some embodiments, the fastener is constructed with at least one of nylon and polyester.

According to some embodiments, there is provided a pair of pneumomassage pants having a hip section which extends proximally to the waist of the subject and distally coupled to a pair of the pneumomassage devices.

According to some embodiments, there is provided a method for adjusting lengths of a distal section and a proximal section of a pneumomassage sleeve, the method comprising the steps of: inserting a subject's leg through a sleeve such that a distal section of the sleeve is positioned onto a foot of the subject, a joint section of a sleeve onto an ankle of the subject, and a proximal section of a sleeve onto a leg of the subject; and coupling a second coupling element coupled to the distal section and a first coupling element coupled to the proximal section to define and secure a position of a bend within the joint section, thereby co-axially aligning the proximal section with a portion of the joint section proximal to the bend, and the distal section with a portion of the joint section distal to the bend to secure a length of the proximal section according to the subject's anatomy.

More details and features of the current invention and its embodiments may be found in the description and the attached drawings.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. It is intended that the embodiments and figures disclosed herein are to be considered illustrative rather than restrictive. The figures are listed below.

DETAILED DESCRIPTION

Disclosed herein is a device comprising: a sleeve sized to cover a first and a second adjacent body parts and an anatomical joint therebetween; and a securing assembly for securing the first and the second adjacent body parts in a fixed position relative to one another, thereby adjusting the sleeve to conform to the lengths of the adjacent body part. Optionally, an angle defined between the first and the second adjacent body parts is adjusted to conform to the joint. Further disclosed is a method for operating the device.

Advantageously, the device disclosed herein may be adjusted to fit various lengths of body parts by applying various alignments of the securing assembly. Further, the device disclosed herein may conform to a joint between two adjacent body parts.

In some embodiments, the sleeve is a pneumomassage sleeve which may function to displace excess fluid and relieve a subject's condition. Non-limiting example of a subject in need of a pneumomassage therapy is a subject afflicted with edema such as lymphedema or other disorder resulting in excess body fluid.

As used herein, the terms "pneumomassage sleeve" and "compression sleeve" are used interchangeably to refer to an inflatable appliance including one or more individually inflatable chambers or cells used for delivering at least some compressive force to some tissue of a patient to relieve a medical condition. These chambers may also be described as compression cells. Typically, a sleeve may encompass one body part such as the chest, or two or more non-contiguous or contiguous body parts such as a combination of foot, ankle, calf (lower leg), and/or thigh (upper leg).

Optionally, the pneumomassage sleeve may envelope one or more inflatable cells. Optionally, the one or more inflatable cells include a series of overlapping inflatable cells which when the sleeve is worn by a subject in need thereof, are sequentially inflated to create massaging forces giving rise to a sequential or peristaltic massage action, pumping the excess fluid away from the foot and the leg of the subject. In a non-limiting example, each of the overlapping inflatable cells may be coupled to a compressor which is controlled to sequentially inflate and deflate the cells.

Non-limiting exemplary means causing the sleeve to function when worn by a subject and controlled pressurized air systems associated with a pneumomassage sleeve are disclosed in U.S. Pat. Nos. 4,338,923, 5,014,681, and 6,406,445.

Throughout the following description, similar elements of different embodiments of the device may be referenced by element numbers differing by integer multiples of 100. For example, a sleeve of FIG. 1 is referenced by the number 102, and a sleeve of FIG. 2, which corresponds to sleeve 102 of FIG. 1, is referenced by the number 202.

Figure 1A:
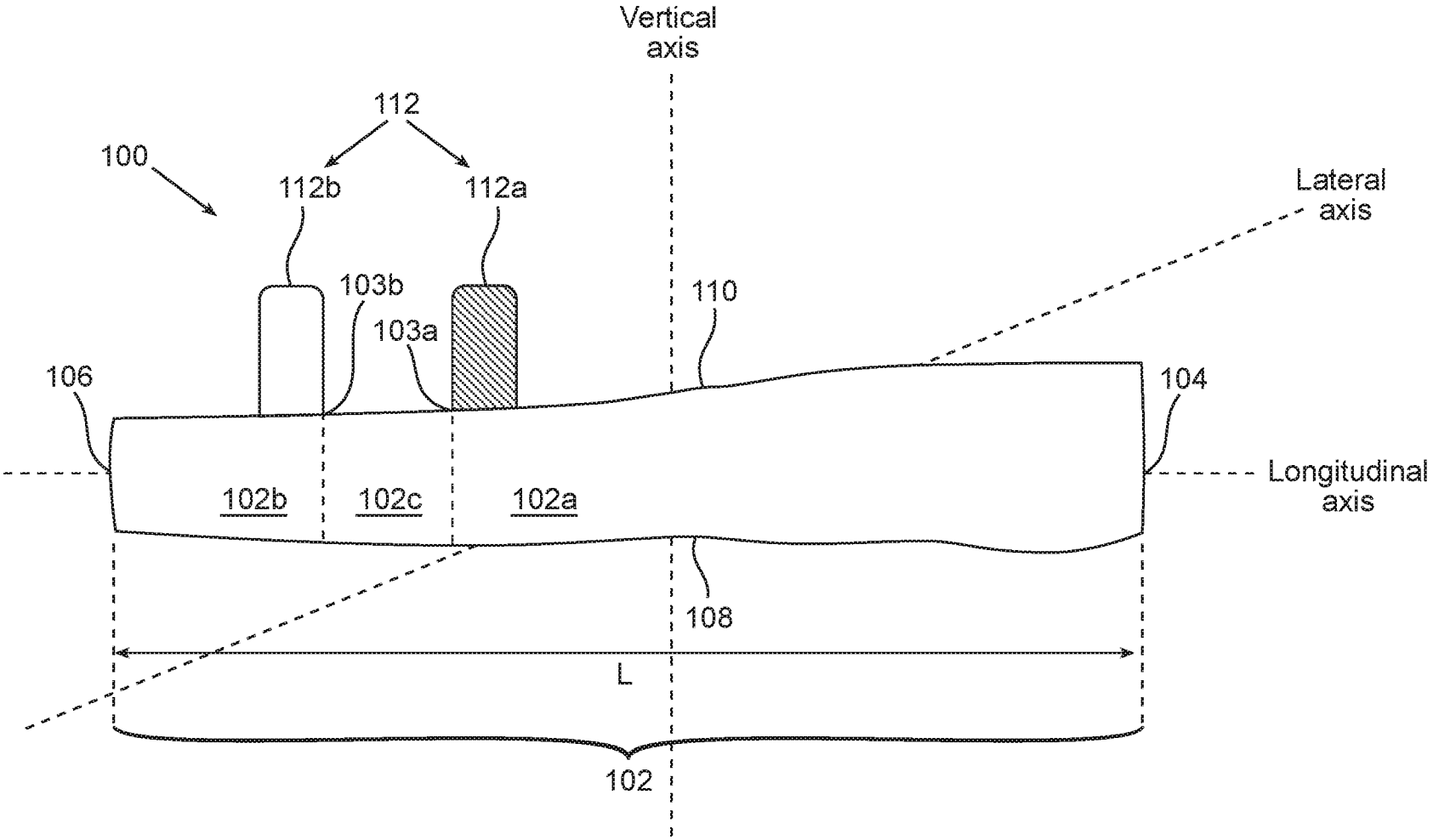
FIG. 1A schematically depicts a device comprising a sleeve which covers a first and a second adjacent body parts and an anatomical joint therebetween in an unsecured configuration, according to an exemplary embodiment of the current invention.
Figure 1B:
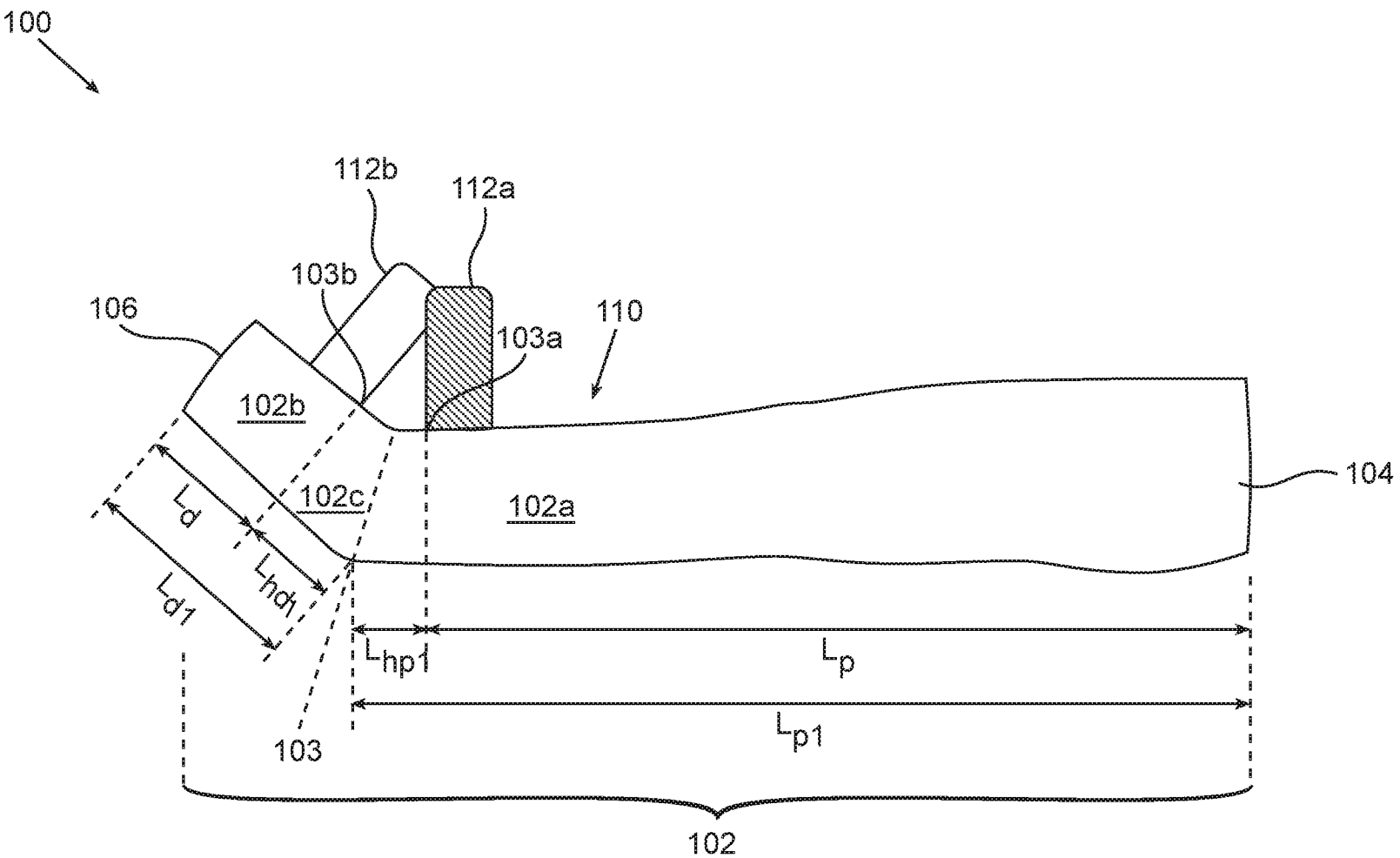
FIG. 1B schematically depicts the device of FIG. 1A in a secured configuration to fit a first desired length of the first body part, according to an exemplary embodiment of the current invention.
Figure 1C:
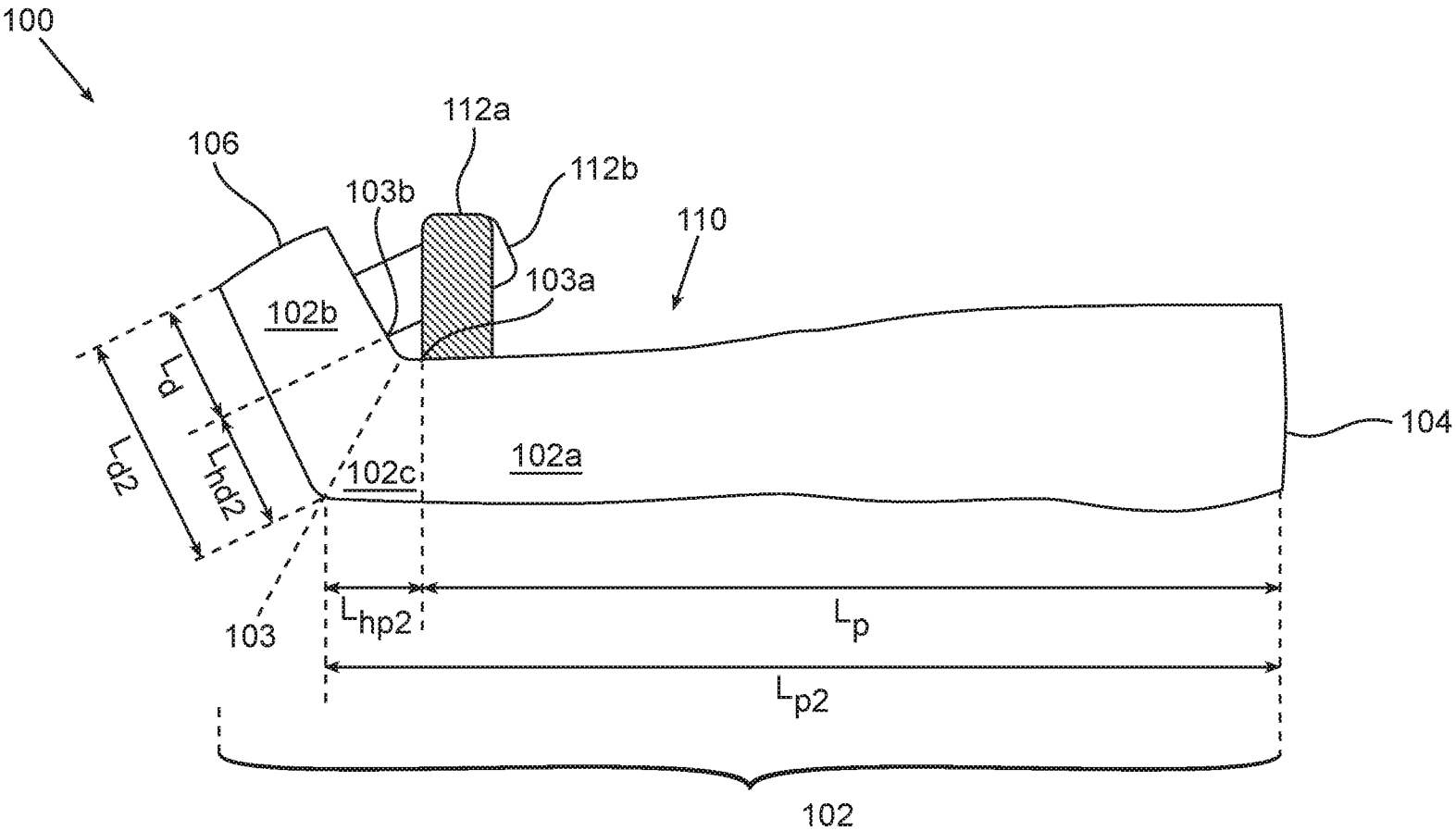
FIG. 1C schematically depicts the device of FIG. 1A in a secured configuration to fit a second desired length of the first body part, according to an exemplary embodiment of the current invention.

Reference is now made to FIGS. 1A, 1B and 1C, which show a device 100 that may be used to cover a first and a second adjacent body parts of various lengths and an anatomical joint therebetween, in accordance with an embodiment.

To facilitate the description of device 100, three orthogonal axes are indicated in FIG. 1A. The axis labelled 'longitudinal axis' refers to a central axis that runs along a length L of sleeve 102 of device 100, from a proximal end 104 to a distal end 106. The axis labelled 'vertical axis' runs from a posterior outer surface 108 to an anterior outer surface 110 of sleeve 102. The axis labelled 'lateral axis' indicates the width of sleeve 102 and is perpendicular to both the vertical and the longitudinal axes.

Device 100 includes a sleeve 102 having a proximal section 102*a* distally coupled to a distal section 102*b* and a joint section 102*c* therebetween; and a securing assembly 112 for releasably securing proximal section 102*a* and distal section 102*b* in a fixed position relative to one another. In a non-limiting example sleeve 102 is a compression sleeve.

Combined lengths of proximal section 102*a*, joint section 102*c*, and distal section 102*b* constitute a length L of sleeve 102. Optionally, length L is predetermined such as to be sufficient to cover a variety of lengths of adjacent body parts with an anatomical joint therebetween. Lengths of proximal section 102*a* and distal section 102*b* may be adjusted to fit onto and conform to adjacent body parts (not shown) of different lengths. Further, a bending within joint section 102*c* may be adjusted to conform to an anatomical joint (not shown) located between the adjacent body parts.

Securing assembly 112 include a first coupling element 112*a* and second coupling element 112*b*, which upon coupling, releasably secure to one another. One non-limiting example of a suitable securing assembly is a hook and loop fastener, such as but not limited to, Velcro. A hook and loop may include a lineal fabric strip with hooks that are configured to couple with another fabric strip with smaller loops, attaching temporarily, until pulled apart. Non-limiting examples of suitable materials for such fastener are nylon and polyester. It is understood that the securing assembly may include any other appropriate mechanism, such as but not limited to, a clip, buckle, ratchet etc. According to some embodiments, an inner surface 113*b* of second coupling element 112*b* may include a hook Velcro layer and an outer surface (hidden from view in the figures) of first coupling element 112*a* may include a loop Velcro layer. According to some embodiments, inner surface 113*b* may include a loop Velcro layer and the outer surface of first coupling element 112*a* may include a hook Velcro layer. Optionally, first coupling element 112*a* and second coupling element 112*b* are coupled/attached to, and extend outward, from an outer surface of sleeve 102. First coupling element 112*a* may be coupled/attached to an outer surface of a distal portion of proximal section 102*a* ranging longitudinally to a proximal end 103*a* of joint section 102*c*. Second coupling element 112*a* may be coupled/attached to an outer surface of a proximal portion of distal section 102*b* ranging longitudinally from a distal end 103*b* of joint section 102*c*. Optionally, the outer surface is an anterior outer surface 110, such as for bending a foot anteriorly towards a leg. In alternative embodiment (not shown), the outer surface may be posterior outer surface 108, such as for bending a calf posteriorly towards a thigh.

According to some embodiments, when sleeve 100 is worn by a subject, proximal end 104 is positioned above the knee of the subject (i.e. on the thigh of the subject). According to some embodiments, when sleeve 100 is worn by a subject, proximal end 104 is positioned below the knee of the subject.

Upon pulling second coupling element 112*b* towards first coupling element 112*a* (e.g., proximally and anteriorly), joint section is bent and distal section 102*b* may move from a first position to a second position relative to proximal section 102*a*. Distal section 102*b* may be secured in a selected position by coupling second coupling element 112*b* to a section of first coupling element 112*a*. Optionally, various coupling configurations of second coupling element 112*b* and first coupling element 112*a* define various bending configurations of joint section 102*c* and positions of distal section 102*b* relative to proximal section 102*b*. A person skilled in the art will appreciate that a sufficient force should be exerted by securing assembly 112 to secure distal section 102*b* in the selected position. Optionally, distal section 102*b* and proximal section 102*a* may transition from an approximately axial alignment to an angular alignment, defining a bend 103 within joint section 102*c* (as shown in FIG. 1B).

The term "approximately axial" refers to an angle α of about 180 degrees, optionally 160 to 200 degrees, defined between outer surface 110 of distal section 102*b* and proximal section 102*a*. The term "angular" refers to an angle α of less than 180 degrees, optionally 30 to 160 degrees, defined between outer surface 110 of distal section 102*b* and proximal section 102*a*.

Referring to FIGS. 1B and 1C, coupling assembly 112 is fixed in two alternative coupling configurations to alternate lengths of proximal and distal sections 102*a* and 102*b*, respectively. The lengths are alternated for proximal section 102*a* to conform to the length of the first body part of different subjects (not shown).

A length $L_p$ of proximal section 102*a* extends at least from proximal end 104 to proximal end 103*a* of joint section 102*c*. An effective length of proximal section 102*a* may be extended by co-axially aligning proximal section 102*a* with at least a portion of joint section 102*c*.

A length $L_d$ of distal section 102*b* extends at least from distal end of joint section 102*c* to distal end 106. An effective length of distal section 102*b* may be extended by co-axially aligning distal section 102*b* with at least a portion of joint section 102*c*.

Referring to FIG. 1B, an effective Length $L_{p1}$ of proximal section 102*a* is composed of length $L_p$ and a length $L_{hp1}$ of a portion of joint section 102*c* co-axially aligned with proximal section 102*a*, and extending from proximal end 103*a* to bend 103 of joint section 102*c*.

Referring to FIG. 1C, an effective Length $L_{p2}$ of proximal section 102*a* is composed of length $L_p$ and a length $L_{hp2}$ of a portion of joint section 102*c* co-axially aligned with proximal section 102*a*, and extending from proximal end 103*a* to bend 103 of joint section 102*c*.

Referring to FIGS. 1B and 1C, length $L_{hp2}$ is shorter than $L_{hp1}$ and $L_{hd2}$ is longer than $L_{hd1}$. Thus, effective length Lp1 of proximal section 102*a* of FIG. 1B, than effective length $L_{p2}$ of proximal section 102*a* of FIG. 1C. Effective length $L_{d1}$ of distal section 102*a* of FIG. 1B, is shorter than effective length $L_{d2}$ of distal section 102*b* of FIG. 1C.

Figures 2A, 2B:
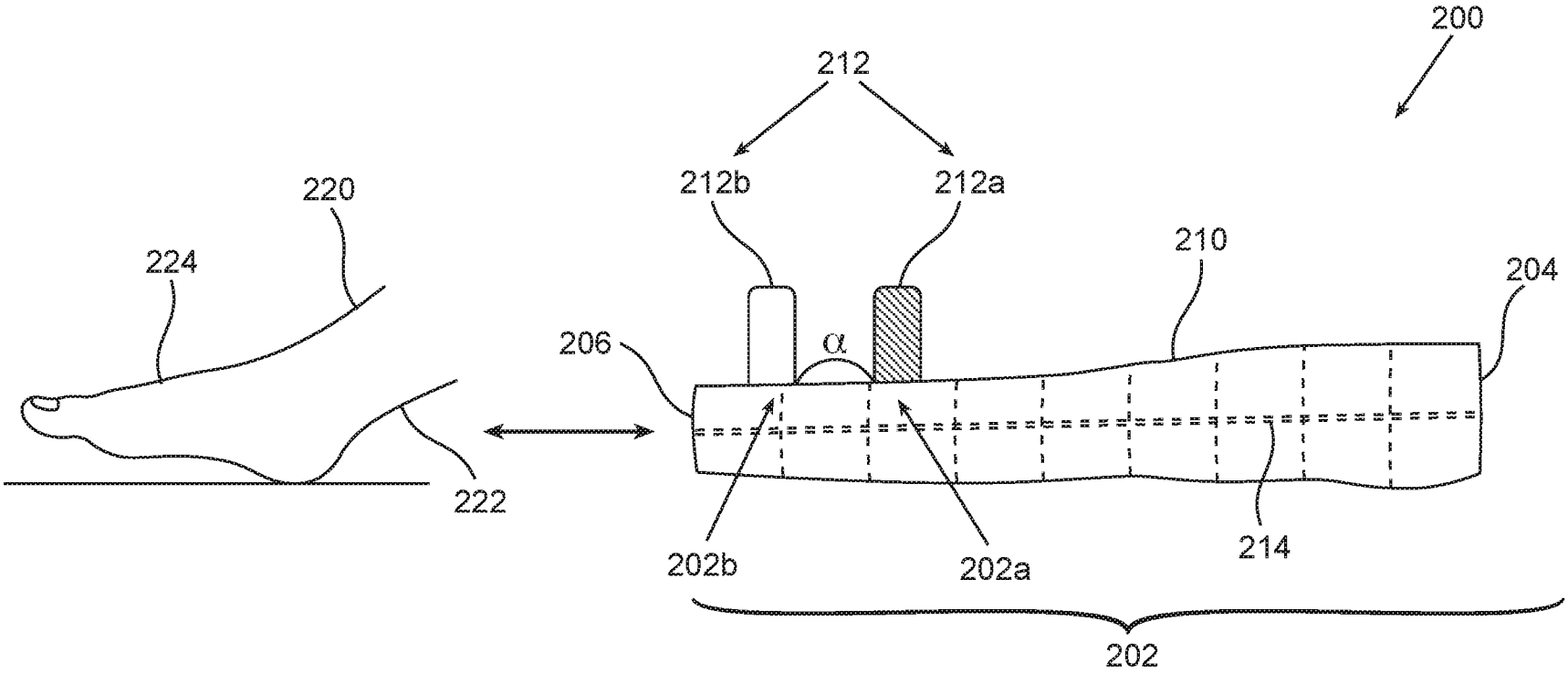
FIG. 2A schematically depicts a device comprising a pneumomassage sleeve and a securing element for securing a distal portion of the pneumomassage sleeve to a proximal portion of the pneumomassage sleeve, in an unsecured configuration, according to an exemplary embodiment of the current invention.
FIG. 2B schematically depicts a foot and a leg enclosed within the device of FIG. 2A, according to an exemplary embodiment of the current invention.
Figure 2C:
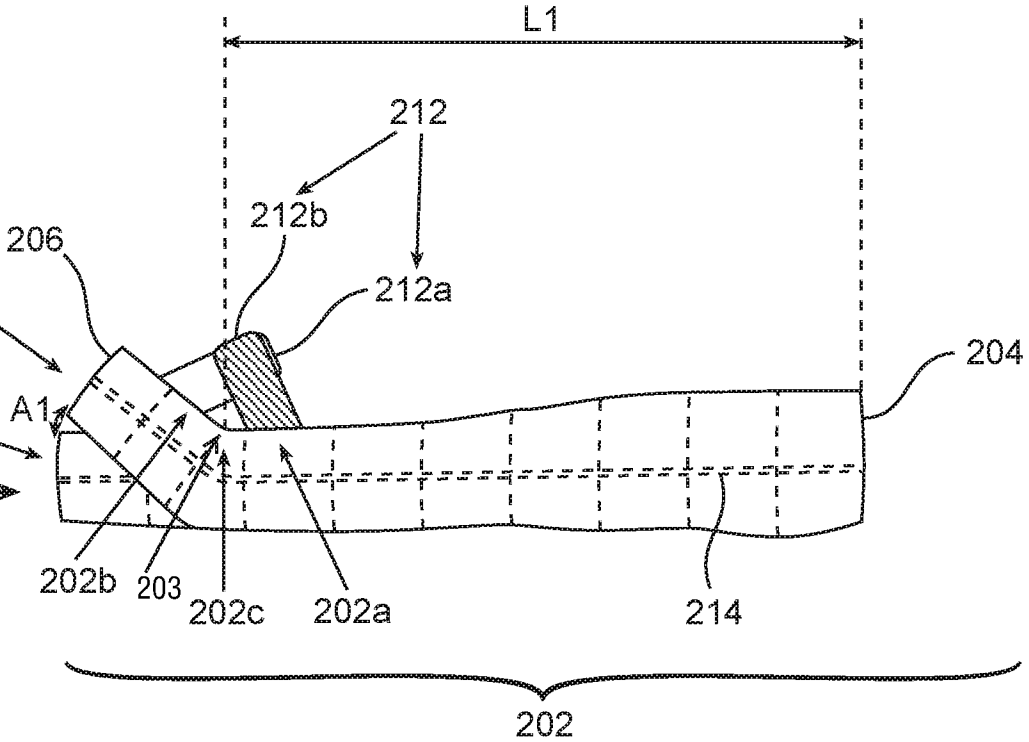
FIG. 2C schematically depicts the device of FIG. 2A in a secured configuration, according to an exemplary embodiment of the current invention.
Figure 2D:
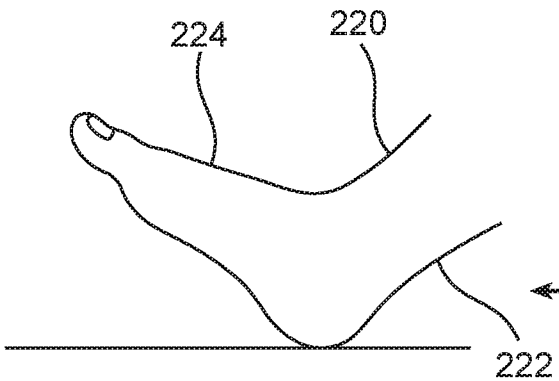
FIG. 2D schematically depicts a foot and a leg enclosed within the device of FIG. 2C, according to an exemplary embodiment of the current invention.
Figure 2E:
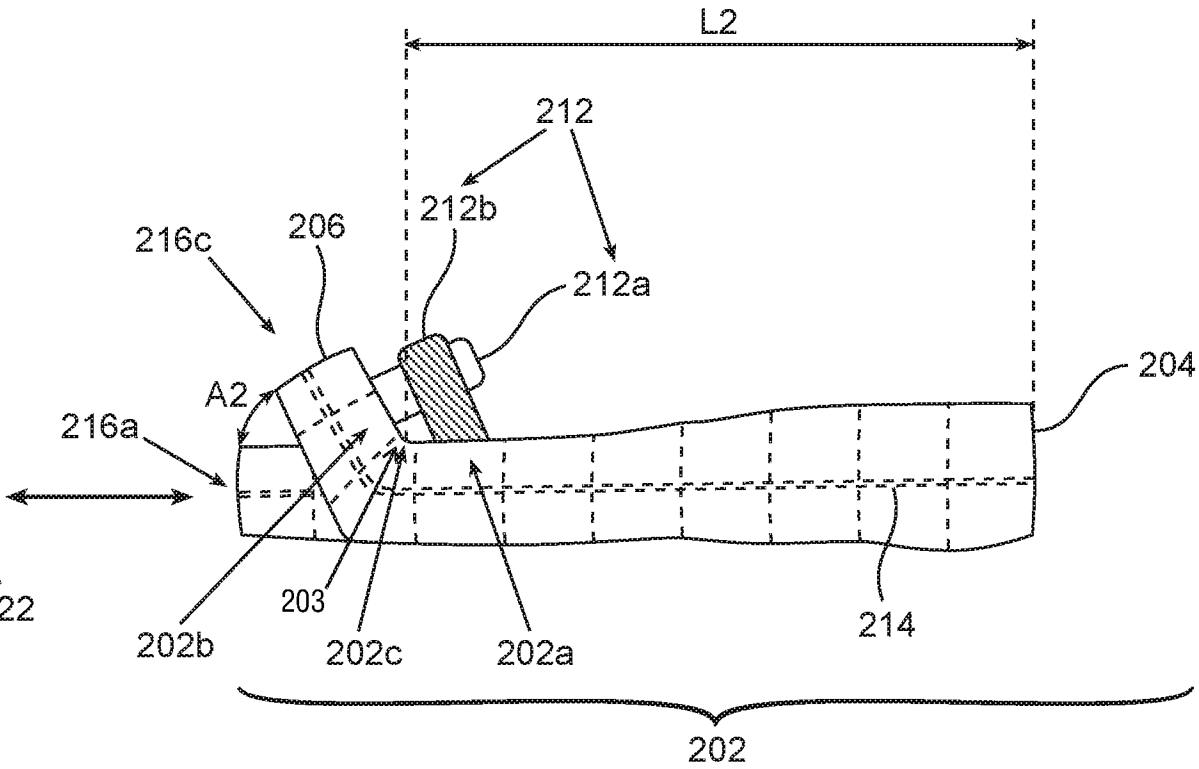
FIG. 2E schematically depicts the device of FIG. 2A in a secured configuration, according to an exemplary embodiment of the current invention.
Figure 2F:
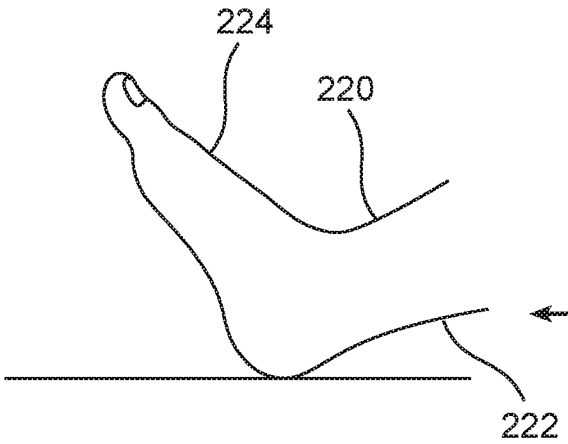
FIG. 2F schematically depicts a foot and a leg enclosed within the device of FIG. 2E, according to an exemplary embodiment of the current invention.

Reference is now made to FIGS. 2A, 2C and 2E, which show a device 200 that may be used for a pneumatic therapy in various configurations that conform to various height of subjects, in accordance with an embodiment. Reference is further made to FIGS. 2B, 2D and 2F which show positioning of a foot enclosed within device 200 of FIGS. 2A, 2C, 2E, respectively. Device 200 is substantially similar to device 100 described in FIGS. 1A-B with the notable difference that sleeve 202 of device 200 is adapted to fit onto a leg 220, an ankle 222 and a foot 224 of subjects of different heights. Sleeve 202 includes a proximal section 202*a* adapted to fit onto and conform to leg 220 a joint section 202*c* adapted to fit onto and conform to ankle 222, and a distal section 202*b* adapted to fit onto and conform to foot 224. Sleeve 202 may have a length sufficient to cover the foot and both the lower and upper leg of subjects of different heights. Alternatively, sleeve 202 may have a length sufficient to cover the foot and the lower leg of subjects of different heights.

Sleeve 202 may be made of a flexible material such as for example, a fabric or a plastic. Optionally, sleeve 202 is made of a sheet that envelops one or more cells formed of air-impermeable material (not shown) which may be inflated and/or deflated in a desired sequence to apply a sequential or peristaltic massage action.

Optionally, sleeve 202 may be further equipped with a zipper 214 which extends along its length from a proximal end 204 to a distal end 206. In such embodiments, sleeve 202 may be opened and closed by zipper 214 to fit onto a leg and foot of a subject.

Referring to FIG. 2A, a first securing element 212*a* and a second securing element 212*b* of a securing assembly 212 are in an uncoupled configuration. Distal section 202*b* and proximal section 202*a* are in an approximately axial alignment. Referring to FIG. 2B, foot 224 enclosed within sleeve 202 of FIG. 2A is biased to an approximately axial alignment.

Reference is now made to FIGS. 2C and 2E which show transitions of sleeve 202 from an axial alignment 216*a* to a first angular alignment 216*b* and to a second angular alignment 216*c*. Each of the angular alignments 216*b* and 216*c* define a position of a bend 203 within joint section 202*c*. In an angular alignment, the length of proximal section 202*a* extends from proximal end 204 to bend 203 and the length of distal section 202*b* extends from bend 203 to distal end 206. Transitions of sleeve 202 to different angular alignments may be utilized to define a desired lengths ratio between proximal and distal sections 202*a* and 202*b*, respectively, to conform to the lengths of a subject's foot and leg.

Referring to FIG. 2C, a first transition of sleeve 202 from an axial alignment 216*a* to a first angular alignment 216*b* may be achieved by pulling/moving distal section 202*b* in an anterior proximal path A1 depicted by a bidirectional angular arrow, thereby defining a first proximal length L1 of proximal section 202*a* extending from proximal end 204 to bend 203 and configured to conform with a first length of a subject's leg extending for example from upper leg to a subject's ankle. To secure first angular alignment 216*b* in place, securing assembly 212 is secured in a first coupling configuration. Referring to FIG. 2D, foot 224 enclosed within sleeve 202 of FIG. 2C is biased to first angular alignment 216*b*.

Referring to FIG. 2E, distal section 202*b* is moved/pulled over an anterior proximal path A2, which is longer than path A1, thereby defining a second proximal length L2 of proximal section 202*a*, extending from proximal end 204 to bend 203 and configured to conform with a second length of a second subject's leg extending for example from upper leg to a subject's ankle. Second proximal length L2 is shorter than first proximal length L1 and therefore may be adapted to shorter people. To secure second angular alignment 216*c* in place, securing assembly 212 is secured in a second coupling configuration. Referring to FIG. 2F, foot 224 enclosed within sleeve 202 of FIG. 2E is biased to second angular alignment 216*b*.

Figures 3A, 3B:
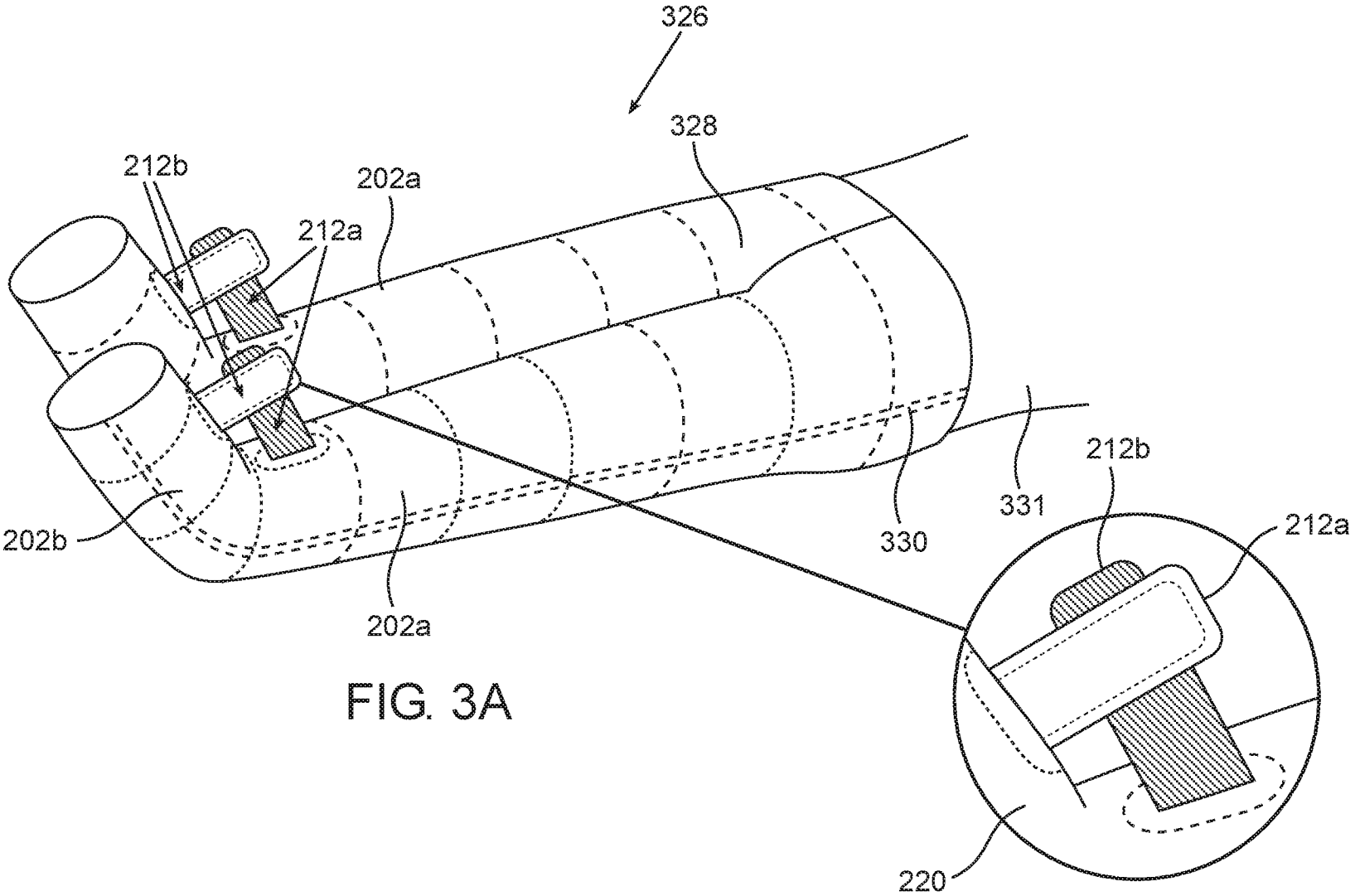
FIG. 3A schematically depicts a kit including a pair of the of FIGS. 2A, 2C, and 2E, according to an exemplary embodiment of the current invention.
FIG. 3B is an enlarged view of a securing assembly of FIG. 3A.

Reference is now made to FIGS. 3A-B which show a pair of pneumomassage pants 326 which may be used for massaging the feet, legs and hips of a subject, in accordance with an embodiment. Pair of pneumomassage pants 326 are adapted to fit onto waists, hips, legs, and feet of a subject. Optionally, pair of pneumomassage pants 326 include a pair of pneumomassage devices 200 described in FIGS. 2A, 2C, and 2E. Optionally, each of pneumomassage devices 200 is proximally coupled to a hip section 328, adapted to fit onto and conform to the hips of the subject 330, and extends to the waists 331 of the subject.

Figure 4:
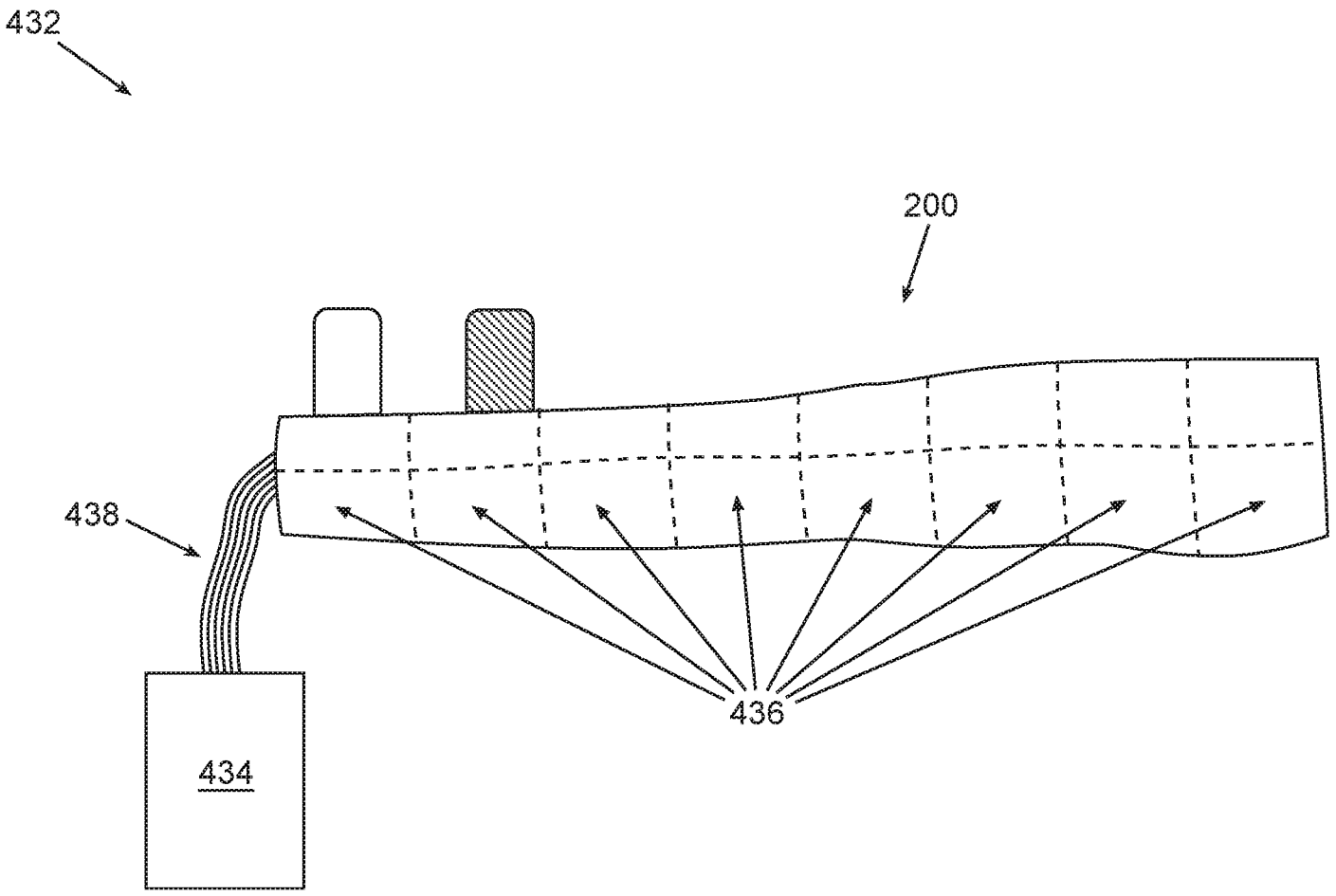
FIG. 4 shows a partially transparent view of a system including the device of FIGS. 2A, 2C, and 2E fluidly connected to a controlled air compressor, according to an exemplary embodiment of the current invention.

Reference is now made to FIG. 4 which shows a system 432 that may be used for a pneumatic therapy, in accordance with an embodiment. System 432 includes device 200 of FIGS. 2A, 2C and 2E, and a controlled air compressor 434 for inflating a series of overlapping inflatable cells 436 enveloped by sleeve 202. Each of inflatable cells 436 is fluidly connected to controlled air compressor 434 which operates to inflate the cells in a desired sequence. Optionally, each of inflatable cells 436 is connectable by an air tube 438 to controlled air compressor 434.

Figure 5:
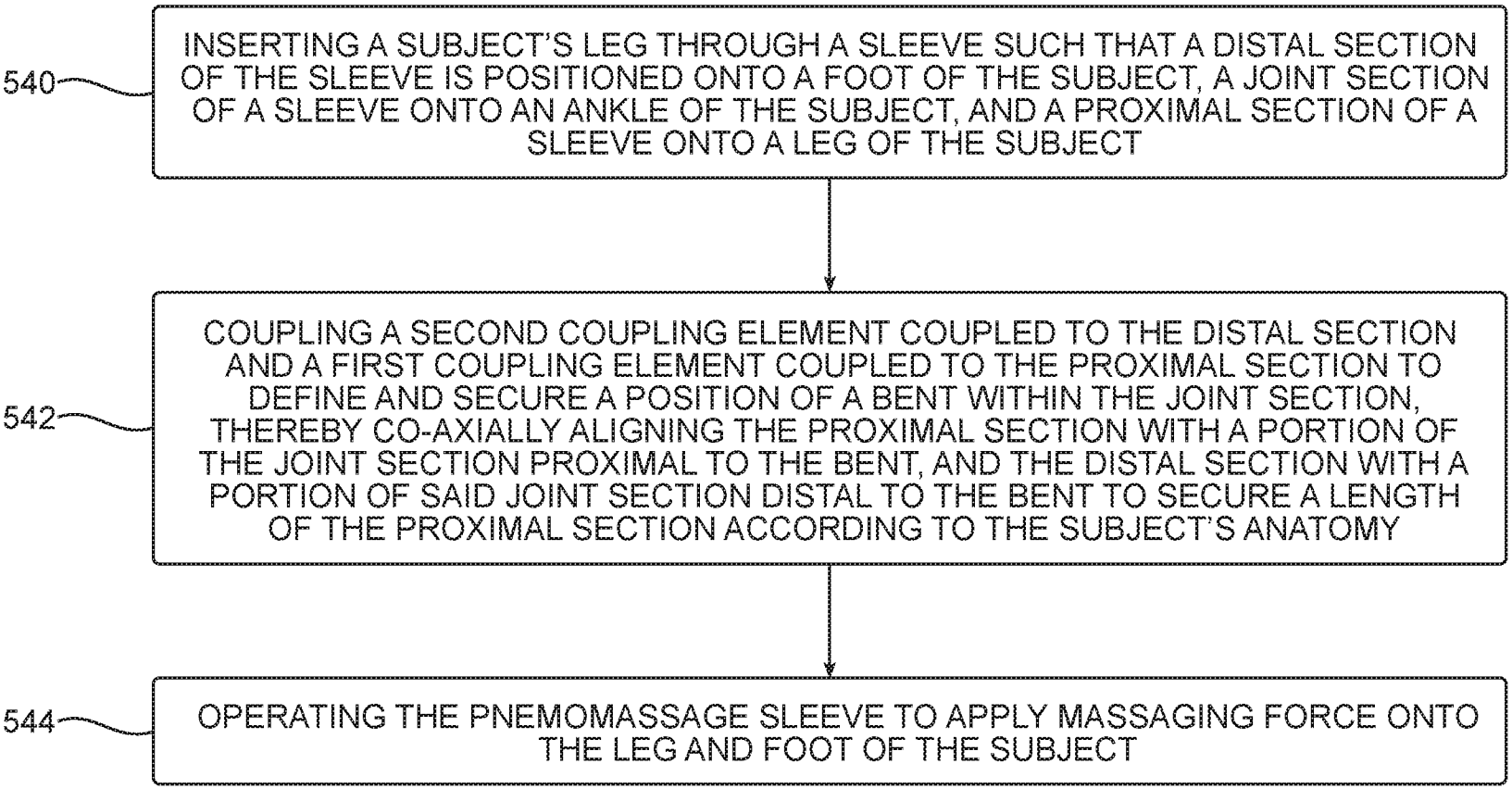
FIG. 5 is a flow chart of the steps of a method for securing a distal section in a fixed position relative to a proximal section of a pneumomassage sleeve, in accordance with the devices of FIGS. 1A-B, 2A, 2C, and 2E and the system of FIG. 4.

Reference is now made to FIG. 5, which is a flow chart of the method for adjusting lengths of a distal section of a pneumomassage sleeve, enclosing a foot of a subject, and a proximal section of a pneumomassage sleeve, enclosing a leg of a subject, in accordance with the device kit and system of FIGS. 2-4. A subject's leg is inserted through a sleeve 202 (FIG. 2A) such that a proximal section 202*a* of sleeve 202 is applied onto a leg, a joint section 202*c* of sleeve 202 is applied onto an ankle and a distal section of sleeve 202 is applied onto a foot of the subject (Step 540). Optionally, sleeve 200 is applied by opening and consequently closing a zipper 214 which extends along its length (FIG. 2A). A second coupling element 212*b* coupled to distal section 202*b* and first coupling element 212*a* coupled to proximal section, are coupled to define and secure a 203 within joint section 202*c*, thereby co-axially aligning proximal section 202*a* with a portion of joint section 202*c* proximal to bend 203, and co-axially aligning distal section 202*b* with a portion of joint section 202*c* distal to bend 203 to secure a length ratio of proximal section 202*a* and distal section 202*b* according to the subject's anatomy (Step 542). The pneumomassage sleeve is operated to apply a massaging force onto the leg and foot of the subject (Step 544). Optionally, the massaging force is applied by sequentially inflating a series of inflatable cells enclosed by sleeve 202. The massaging may induce a sequential or peristaltic action moving from the leg and the foot toward the torso of the subject.

While a number of exemplary aspects and embodiments have been discussed above, those of skill in the art will recognize certain modifications, permutations, additions and sub-combinations thereof. It is therefore intended that the following appended claims and claims hereafter introduced be interpreted to include all such modifications, permutations, additions and sub-combinations as are within their true spirit and scope.

In the description and claims of the application, each of the words "comprise" "include" and "have", and forms thereof, are not necessarily limited to members in a list with which the words may be associated.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What I claim is:

1. A pneumomassage device comprising:

a pneumomassage sleeve adapted to fit onto a first body part, a second adjacent body part and an anatomical joint therebetween, said sleeve comprising:

a proximal section that is configured to conform to the first body part;

a distal section that is configured to conform to the second body part; and a joint section between said proximal section and said distal section that is configured to conform to the anatomical joint, wherein an effective length of the proximal section and a portion of the joint section coaxially aligned with the proximal section and extending from a proximal end to a bend of the joint section; and a releasable securing assembly comprising:

a first coupling element coupled to and extending outward from an outer surface of said proximal section of said sleeve; and a second coupling element coupled to and extending outward from an outer surface of said distal section of said sleeve, wherein said first coupling element is configured for coupling to said second coupling element, wherein upon coupling of said first coupling element to said second coupling element, a relative position between said first coupling element and said second coupling element defines a position of the bend within said joint section, thereby the effective length of the proximal section and the portion of the joint section is adjustable by co-axially aligning the proximal section with the portion of the joint section, such that the effective length is alternated for the proximal section and the portion of the joint section, to conform to a length of the first body part of different subjects, wherein said sleeve is configured to provide a pneumomassage irrespective of the length of the first body part.

2. The device of claim 1, wherein said first coupling element extends perpendicularly to said proximal section and wherein said second coupling element extends perpendicularly to said distal section.

3. The device of claim 1, wherein said first coupling element is positioned on an anterior side of said proximal section and said second coupling element is positioned on an anterior side of said distal section.

4. The device of claim 1, wherein said first and/or second coupling elements are integrally formed with said respective proximal and/or distal sections.

5. The device of claim 1, wherein said first and/or second coupling elements are in the form of elongated straps.

6. The device of claim 1, wherein the releasable securing assembly comprises a hook-and-loop fastener.

7. The device of claim 6, wherein said fastener consists of a lineal fabric strip with hooks that configured to couple with another fabric strip with smaller loops, attaching temporarily, until pulled apart.

8. The device of claim 7, wherein said fastener is constructed with at least one of nylon and polyester.

9. The device of claim 1, wherein the pneumomassage sleeve envelops one or more inflatable cells formed of air-impermeable material.

10. The device of claim 9, wherein each of the one or more inflatable cells is fluidly connected to an air compressor which operates to inflate and/or deflate the one or more cells.

11. The device of claim 10, wherein the one or more inflatable cells comprise a plurality of cells configured to be inflated and/or deflated in a desired sequence.

12. The device of claim 9, wherein the one or more inflatable cells comprise a plurality of cells configured to be inflated and/or deflated in a desired sequence.

13. A pair of pneumomassage pants comprising a hip section which is configured to extend proximally to the waist of a subject and distally coupled to a pair of devices as set forth in claim 1.

14. A method for adjusting lengths of a distal section and a proximal section of a pnemomassage sleeve, said method comprising the steps of:

providing a pneumomassage device comprising:

a pneumomassage sleeve configured to fit onto a first body part, a second adjacent body part and an anatomical joint therebetween, said sleeve comprising:

a proximal section configured to conform to the first body part;

a distal section configured to conform to the second body part; and a joint section between said proximal section and said distal section that is configured to conform to the anatomical joint, wherein an effective length of the proximal section and a portion of the joint section coaxially aligned with the proximal section, and extending from the proximal end to a bend of the joint section; and a releasable securing assembly comprising:

a first coupling element coupled to and extending outward from an outer surface of said proximal section of said sleeve; and a second coupling element coupled to and extending outward from an outer surface of said distal section of said sleeve; and coupling said first coupling element to said second coupling element, thereby a relative position between first coupling element and said second coupling element defines a position of the bend within said joint section, and adjusting the effective length of the proximal section and the portion of the joint section by co-axially aligning the proximal section with the portion of the joint section, such that the effective length is alternated for the proximal section and the portion of the joint section to conform to a length of the first body part of different subjects, wherein said sleeve is configured to provide a pneumomassage to the body part irrespective of the length of the first body part.

* * * * *